US005897065A

United States Patent [19]

Schwelling

[11] Patent Number: 5,897,065

[45] Date of Patent: Apr. 27, 1999

[54] COLLECTING CONTAINER FOR PAPER SHREDDERS OF SIMILAR COMMINUTING DEVICES

[76] Inventor: Hermann Schwelling, Hartmannweg 5, 88682 Salem, Germany

[21] Appl. No.: 08/942,849

[22] Filed: Oct. 2, 1997

[30] Foreign Application Priority Data

Oct. 9, 1996 [DE] Germany ..... 296 17 501 U
Dec. 28, 1996 [DE] Germany ..... 296 22 522 U

[51] Int. Cl.[6] ..... B02C 19/00

[52] U.S. Cl. ..... 241/100; 241/236; 241/285.1

[58] Field of Search ..... 241/100, 236, 241/285.1, 285.2, 285.3

[56] References Cited

U.S. PATENT DOCUMENTS

| | | | |
|---|---|---|---|
| 3,682,402 | 8/1972 | Goldhammer | 241/100 |
| 3,711,034 | 1/1973 | Ehinger | 241/100 |
| 4,637,560 | 1/1987 | Goldhammer | 241/100 |
| 4,650,128 | 3/1987 | Goldhammer | 241/36 |
| 4,700,902 | 10/1987 | Yeomans | 241/100 |
| 5,269,473 | 12/1993 | Strohmeyer et al. | 241/100 |
| 5,607,112 | 3/1997 | Wilson | 241/33 |
| 5,704,558 | 1/1998 | Arrott | 241/47 |

*Primary Examiner*—John M. Husar
*Attorney, Agent, or Firm*—Friedrich Kueffner

[57] ABSTRACT

A collecting container for collecting cut material of paper shredders or similar comminuting devices in which the cutting mechanism of the paper shredder rests with its housing on a box-like or frame-like base frame having a fixed bottom, and wherein the container can be pushed into the base frame from the front side of the paper shredder underneath the cutting mechanism housing. The container and the base frame have at the bottom thereof positively engageable guide elements.

5 Claims, 2 Drawing Sheets

COLLECTING CONTAINER FOR PAPER SHREDDERS OF SIMILAR COMMINUTING DEVICES

BACKGROUND OF THE INVENTION

1. Field of the Invention

The present invention relates to a collecting container for collecting cut material of paper shredders or similar comminuting devices in which the cutting mechanism of the paper shredder rests with its housing on a box-like or frame-like base frame having a fixed bottom, and wherein the container can be pushed into the base frame from the front side of the paper shredder underneath the cutting mechanism housing.

2. Description of the Related Art

In constructions of the type described above, narrow tolerances are required between the collecting container and the walls of the base frame, in order to minimize the discharge of particles and dust resulting from cutting into the ambient air. On the other hand, the narrow space conditions, in turn, make it difficult, once the container has been emptied, to once again easily push the collecting container back into the base frame without jamming or tilting.

SUMMARY OF THE INVENTION

Therefore, it is the primary object of the present invention to eliminate the deficiencies described above by providing suitable measures primarily with respect to the container bottom and the base frame bottom.

In accordance with the present invention, the container and the base frame have at the bottom thereof positively engageable guide elements.

In accordance with a further development of the present invention, the positively engageable guide elements are a guide groove provided in the container bottom and a corresponding guide pin or the like provided on the bottom of the base frame.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
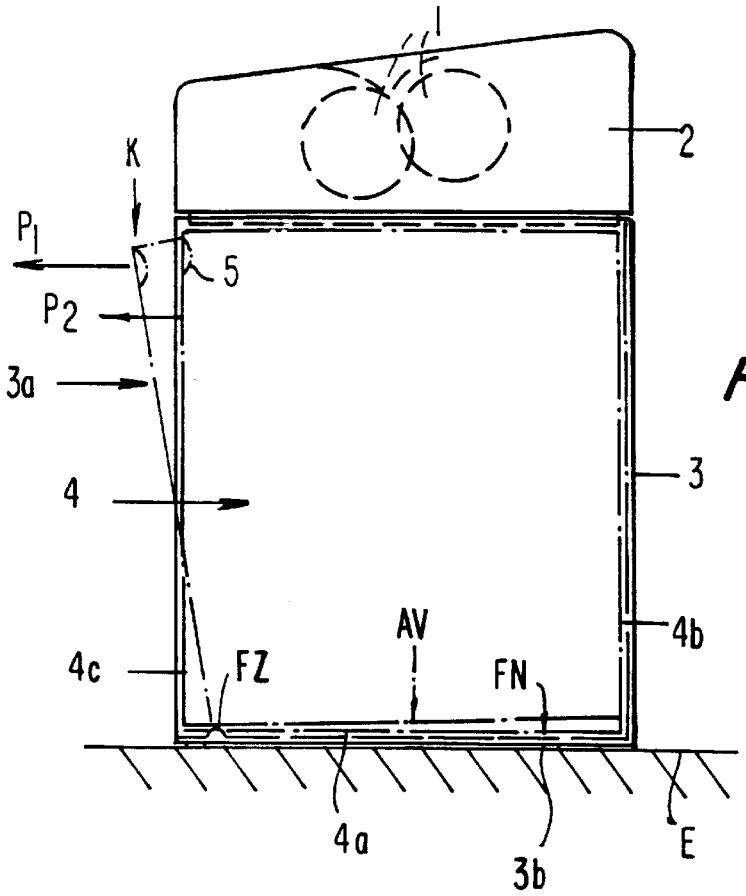
FIG. 1 is a schematic side view of a paper shredder according to the present invention.

FIG. 1 of the drawing is a schematic illustration of a collecting container 4 for cut material for a paper shredder or a similar comminuting device. The paper shredder includes a cutting mechanism mounted with its housing 2 on a box-like or frame-like base frame 3 with a fixed bottom 3*b*. The container 4 is pushed from the open front side of the paper shredder under the cutting mechanism housing 2 into the base frame 3.

Figure 2:
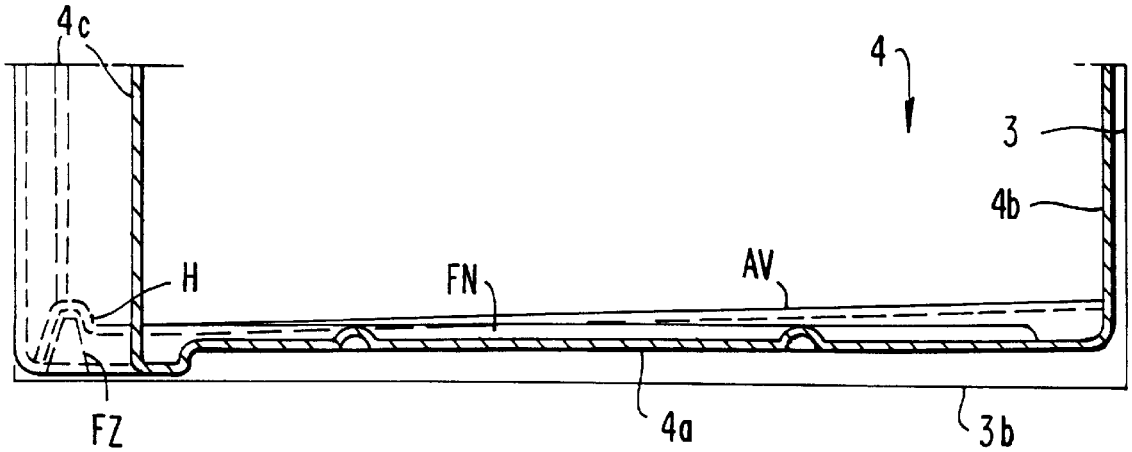
FIG. 2 is a longitudinal sectional view, on a larger scale, of the bottom area of the container and base frame of the paper shredder of FIG. 1.
Figure 3:
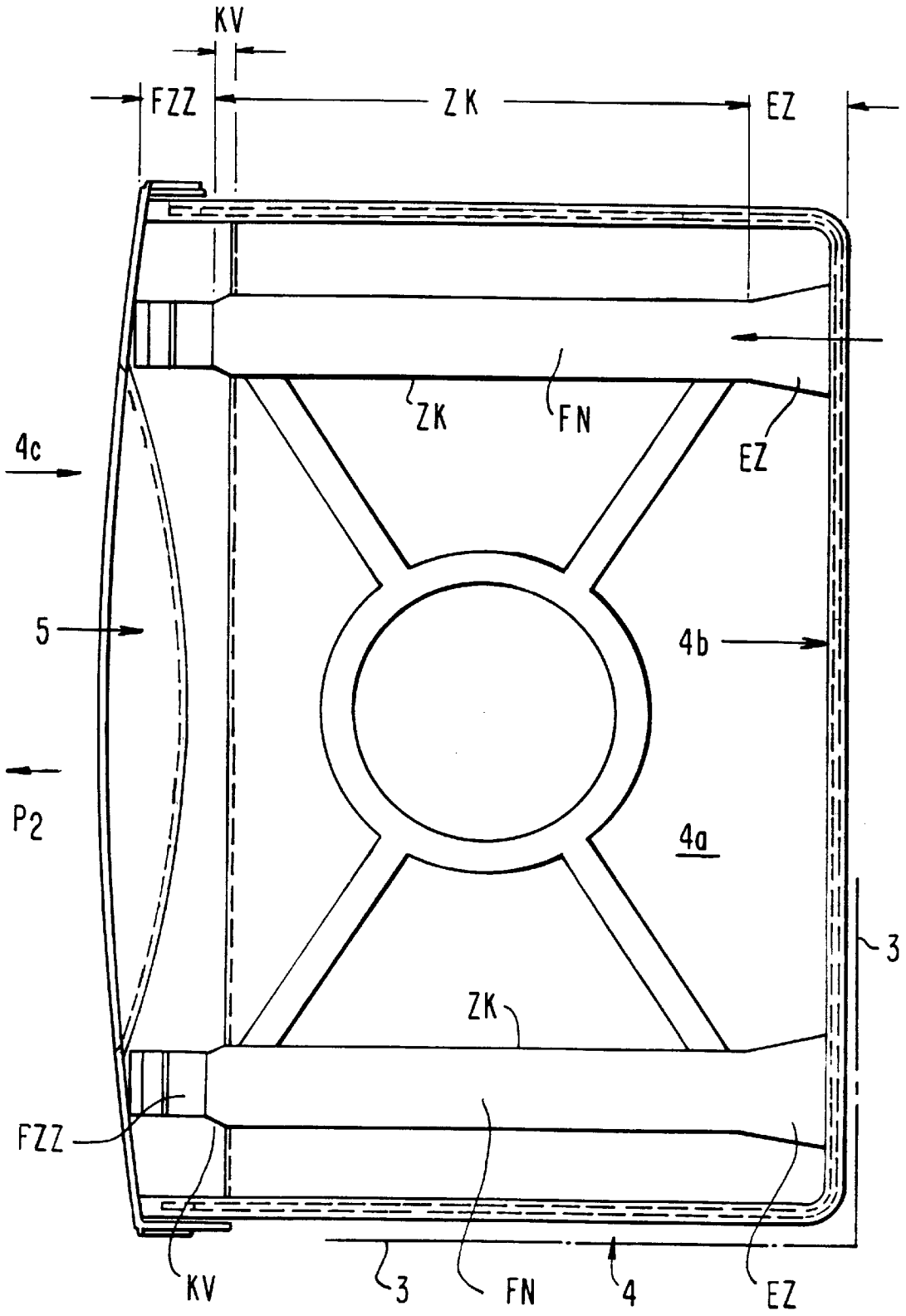
FIG. 3 is top view of the collecting container bottom of FIG. 2.

In accordance with the present invention, as particularly shown in FIGS. 2 and 3, guide elements FN and FZ which can be placed into positive engagement with each other are arranged in the bottom areas 4*a* and 3*b* of container 4 and base frame 3, respectively.

In accordance with a specific structural feature of the present invention, the positively engageable guide elements are at least one guide groove FN provided in the container bottom 4*a* and a corresponding guide pin FZ or the like provided on the bottom 3*b* of the base frame 3. In practical use, however, it is advantageous to arrange the positively engageable elements FN and FZ horizontally spaced from each other on both sides of the container bottom 4*a* and the fixed bottom 3*b* of the base frame 3.

For achieving the object of easily inserting the collecting container without jamming into the base frame in an optimum manner, the present invention further provides that the guide groove FN, which is open toward the rear side 4*b* of the container, has a conically narrowing insertion zone EZ and a centering duct ZK with parallel walls adjacent the insertion zone EZ. Further toward the front side 4*c* of the container 4, the guide groove has another conically narrowing section KV serving as the actual fine centering zone FZZ. The fine centering zone FZZ, which is also constructed in the manner of a duct, has at its end an expanded section H extending upwardly from the container bottom 4*a*, wherein, in the end position of the container 4 shown in FIG. 1, the expanded section H is placed in the manner of a hood on the corresponding guide pin FZ of the base frame bottom 3*b*. By pulling at the recessed grip 5 of the container 4 toward the front in the direction of arrow $P_1$, the container 4 can now be easily moved into a tilted position as indicated by K in FIG. 1, so that documents which are not confidential or other waste paper, etc., can be thrown directly into the container.

The container 4 can be moved out of the base frame 3 by slightly lifting the container 4 and pulling the container 4 also at the recessed grip 5 in the direction P2 shown in FIG. 1.

When the collecting container 4 is pushed into or pulled out of the base frame 3, the initial centering zone or centering duct ZK which has a channel-like cross-section, and which additionally has a slightly ascending extension AV relative to the container bottom 4*a* toward the rear side 4*b*, ensures that the container 4 sliding on the guide pin FZ is slightly raised and, thus, there is only little resistance to the movement of the container 4.

Finally, also important for the operation of the entire paper shredder is the fact that a so-called switching vane is mounted on one of the container sides in the upper forward portion thereof. By interacting with a limit switch, the switching vane causes the drive of the cutting mechanism 1 to be stopped when the collecting container 4 is moved in the direction of arrow $P_2$ shown in FIG. 1 out of the base frame 3 which is open toward the front 3*a* . The switching vane acts in the same manner if the container 4 is tilted forwardly in accordance with the direction of arrow $P_1$ from its end position shown in FIG. 1 in order to throw waste paper or other non-confidential documents into the container 4. During this tilting movement, the guide pins FZ serve as pivots and the rear container edge serves as a limiting stop for the tilting movement, so that, after the container 4 is released, it moves back by itself into its original position.

The invention is not limited by the embodiments described above which are presented as examples only but can be modified in various ways within the scope of protection defined by the appended patent claims.

I claim:

1. A collecting container in combination with a paper comminuting device, wherein the paper shredder comprises a base frame with a fixed bottom, a cutting mechanism and a housing for the cutting mechanism being mounted on the base frame, the base frame having an open front side, wherein the collecting container is movable into and out of the base frame underneath the cutting mechanism housing through the open front side, the container having a bottom, further comprising positively engagable guide elements mounted on the bottom of the container and on the bottom of the base frame for positively engaging the container and the base frame, wherein the positively engagable guide elements comprise at least one guide groove in the container bottom and a guide pin mounted on the bottom of the base frame, wherein the guide pin is engagable in the guide groove, and wherein the guide groove has at the front side of the container an expanded section extending upwardly from the container bottom, wherein, in an end position of the container, the expanded section rests in the manner of a hood on the guide pin of the bottom of the base frame.

2. The collecting container according to claim 1, comprising positively engageable guide elements arranged horizontally spaced apart on both sides of the bottom of the container and the bottom of the base frame.

3. The collecting container according to claim 1, wherein the guide groove is open toward a rear side of the container, the guide groove having at the rear side of the container a conically narrowing insertion zone, a centering duct adjacent the insertion zone and another conical narrowing section as a fine centering zone adjacent the centering duct and extending toward the front side of the container.

4. The collecting container according to claim 3, wherein the centering duct is configured to ascend relative to the container bottom toward the rear side of the container.

5. The collecting container according to claim 1, wherein the container comprises a switching vane.

* * * * *